US007500332B2

(12) United States Patent
Garcia

(10) Patent No.: US 7,500,332 B2
(45) Date of Patent: Mar. 10, 2009

(54) RAIN GUTTER DIVERTER

(76) Inventor: Edward E. Garcia, 1902 Edmore Ave., Rowland Heights, CA (US) 91748

( * ) Notice: Subject to any disclaimer, the term of this patent is extended or adjusted under 35 U.S.C. 154(b) by 617 days.

(21) Appl. No.: 11/370,374

(22) Filed: Mar. 8, 2006

(65) Prior Publication Data

US 2007/0209289 A1 Sep. 13, 2007

(51) Int. Cl.
*E04D 13/00* (2006.01)
*E04D 13/14* (2006.01)

(52) U.S. Cl. ..... 52/58; 52/97; 52/11; 52/12; 52/13; 52/60; 52/61; 52/62; 52/94; 52/96

(58) Field of Classification Search ..... 52/11, 52/97; 137/357
See application file for complete search history.

(56) References Cited

U.S. PATENT DOCUMENTS 853,897 A * 5/1907 Porter ..... 52/24
2,899,916 A 8/1959 Ertman
5,333,417 A 8/1994 Demartini
5,333,419 A 8/1994 Hickner
5,675,939 A 10/1997 Hickner
6,009,672 A 1/2000 Kuhns
6,412,229 B2 7/2002 Kuhns
6,481,164 B1 11/2002 McCorkel
2004/0255522 A1 12/2004 Knudson et al.

* cited by examiner

*Primary Examiner*—Thu Nguyen
*Assistant Examiner*—Babajide Demuren
(74) *Attorney, Agent, or Firm*—Kenneth L. Green; Edgar W. Averill, Jr.

(57) ABSTRACT

A rain gutter diverter includes a body and a diverter wall. The body includes a roof and side walls to capture water running down a valley between roof sections. The diverted wall forms a vertical splitter and directs the captured flow into the gutter.

12 Claims, 6 Drawing Sheets

RAIN GUTTER DIVERTER

BACKGROUND OF THE INVENTION

The present invention relates to rain gutters and in particular to diverters for diverting a flow of water into the gutters which otherwise might overshoot the gutters.

Rain gutters are often attached to lower edges of roofs to catch and control runoff during rain storms. Such gutters are very effective along straight roof edges. However, at locations where rain runoff is concentrated, the flow of water often overshoots the gutter, and results in a stream of water shooting off the roof. Compounding the problem, roof lines often include a meeting of two roof portions near an entry to the house. When such meeting forms a "V", the flow of rain runoff is concentrated in the "V" and may easily overshoot the gutter and produce a waterfall off of the roof. When this occurs near an entry, the result may be both annoying and produce a slippery walkway.

BRIEF SUMMARY OF THE INVENTION

The present invention addresses the above and other needs by providing a rain gutter diverter which includes a body and a diverter wall. The body includes a roof and side walls to capture water running down a valley between roof sections. The diverted wall forms a vertical splitter and directs the captured flow into the gutter.

In accordance with one aspect of the invention, there is provided a rain gutter diverter. The rain gutter diverter comprising a diverter body and a diverter wall. The diverter body includes a body roof, a body right side wall, a body left side wall, a body centerline, a mouth end, and a diverter end. The body right side wall extends downward from a roof right edge, and the body left side wall extending downward from a roof left edge. The diverter wall is attached to the diverter end of the diverter body and comprising a right diverter wall, a left diverter wall and a vertical splitter separating the right diverter wall from the left diverter wall. The vertical splitter forms a "V" pointed toward the mouth end of the diverter body. The body roof meets and is substantially sealed to top edges of the right diverter wall and the left diverter wall. The body right side wall meets and is substantially sealed to a right edge of the right divert wall. The body left side wall meets and is substantially sealed to a left edge of the left diverter wall.

BRIEF DESCRIPTION OF THE SEVERAL VIEWS OF THE DRAWING

The above and other aspects, features and advantages of the present invention will be more apparent from the following more particular description thereof, presented in conjunction with the following drawings wherein:

FIG. 2A is a detailed view of the rain gutter diverter on a roof.

Corresponding reference characters indicate corresponding components throughout the several views of the drawings.

DETAILED DESCRIPTION OF THE INVENTION

The following description is of the best mode presently contemplated for carrying out the invention. This description is not to be taken in a limiting sense, but is made merely for the purpose of describing one or more preferred embodiments of the invention. The scope of the invention should be determined with reference to the claims.

Figure 1:
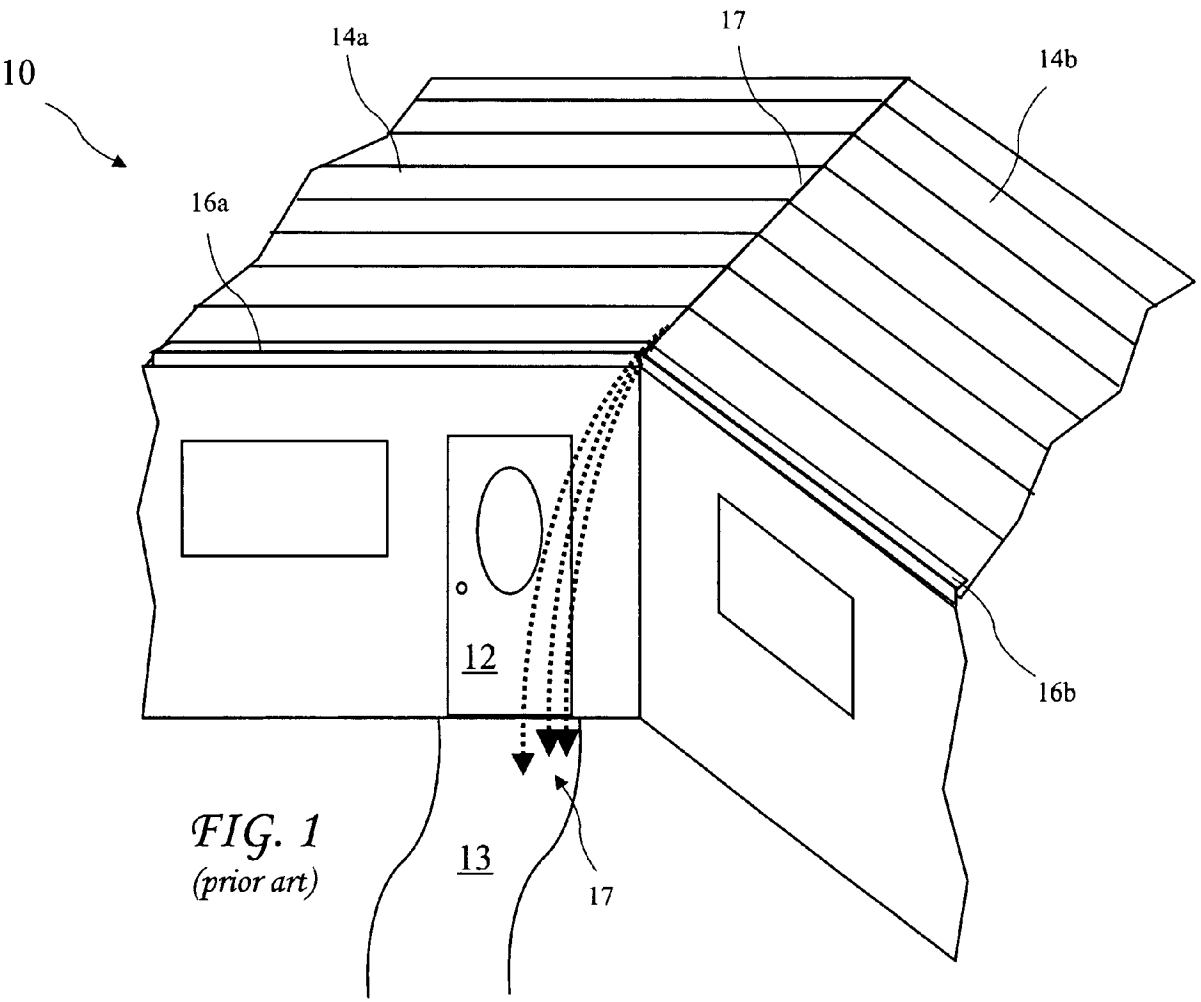
FIG. 1 (prior art)
FIG. 1 is a prior art rain gutter system.

A house 10 having a prior art rain gutter system having two gutter sections 16*a* and 16*b* are shown in FIG. 1. The gutter sections 16*a* and 16*b* are attached to bottom edges of corresponding roof sections 14*a* and 14*b*. The roof sections 14*a* and 14*b* meet where a roof valley 17 between the roof sections 14*a* and 14*b* intersect the bottom edges of the roof. Such meeting point is often proximal to an entry 12 and a walkway leading to the entry 12. Unfortunately, during moderate to hard rain, a large amount of water running down the valley 17 is too great to merely flow into the gutter sections 16*a* and 16*b*, and a large amount of water may overshoot the gutter sections 16*a* and 16*b* and cause a waterfall 17 proximal to the entry 12.

Figures 2, 2B:
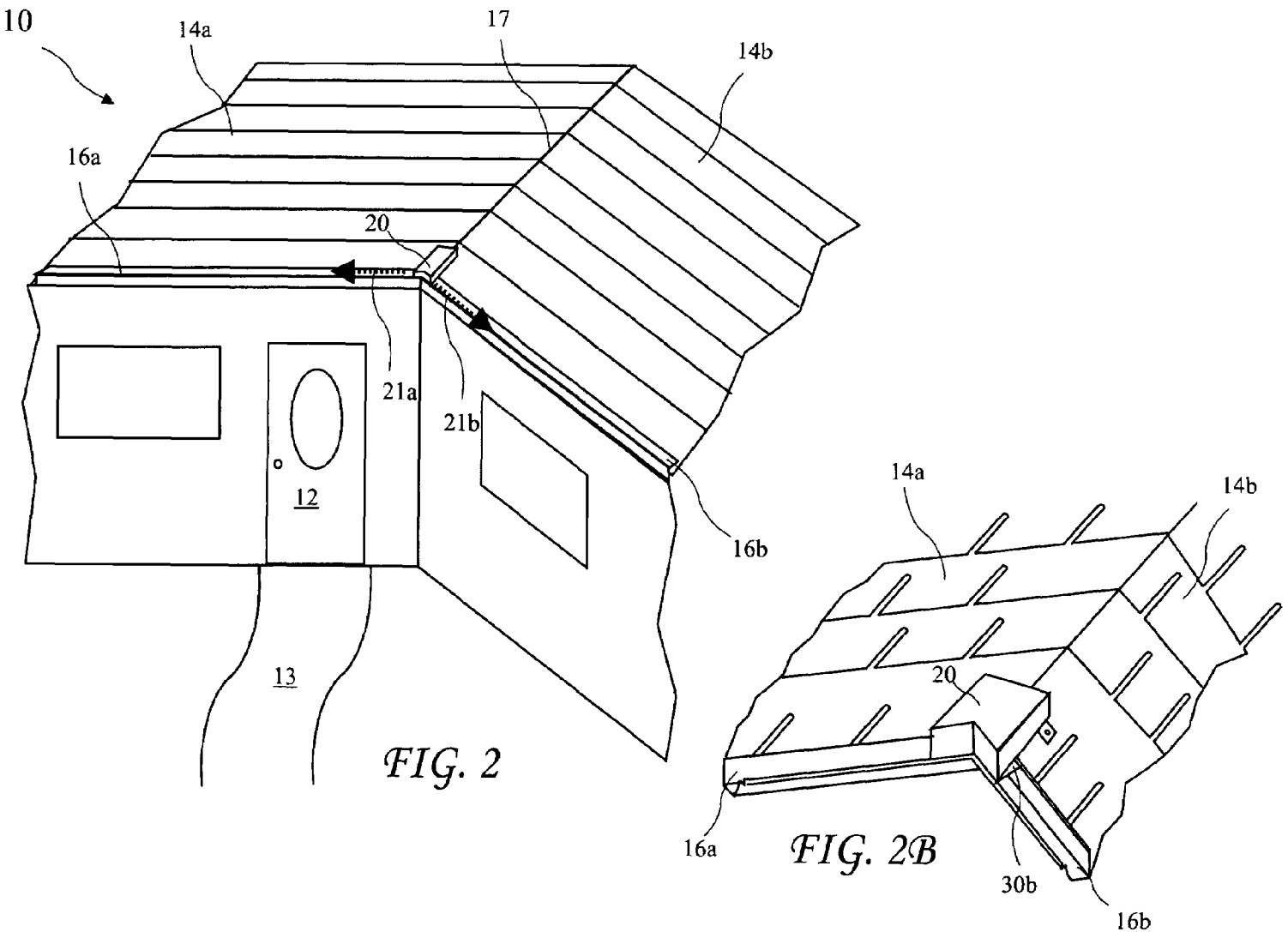
FIG. 2 is a rain gutter system including a rain gutter diverter according to the present invention.

A house 10 with a rain gutter system including a rain gutter diverter 20 according to the present invention is shown in FIG. 2, and a more detailed view of the rain gutter diverter 20 on the roof 14*a*, 14*b* is shown in FIG. 2B. The rain gutter diverter 20 captures some or all of the water running down the valley 17 and diverts the water into the gutter sections 16*a* and 16*b*. Guides 30*a* (not shown) and 30*b* help guide the water into the gutters 16*a* and 16*b*.

Figure 3:
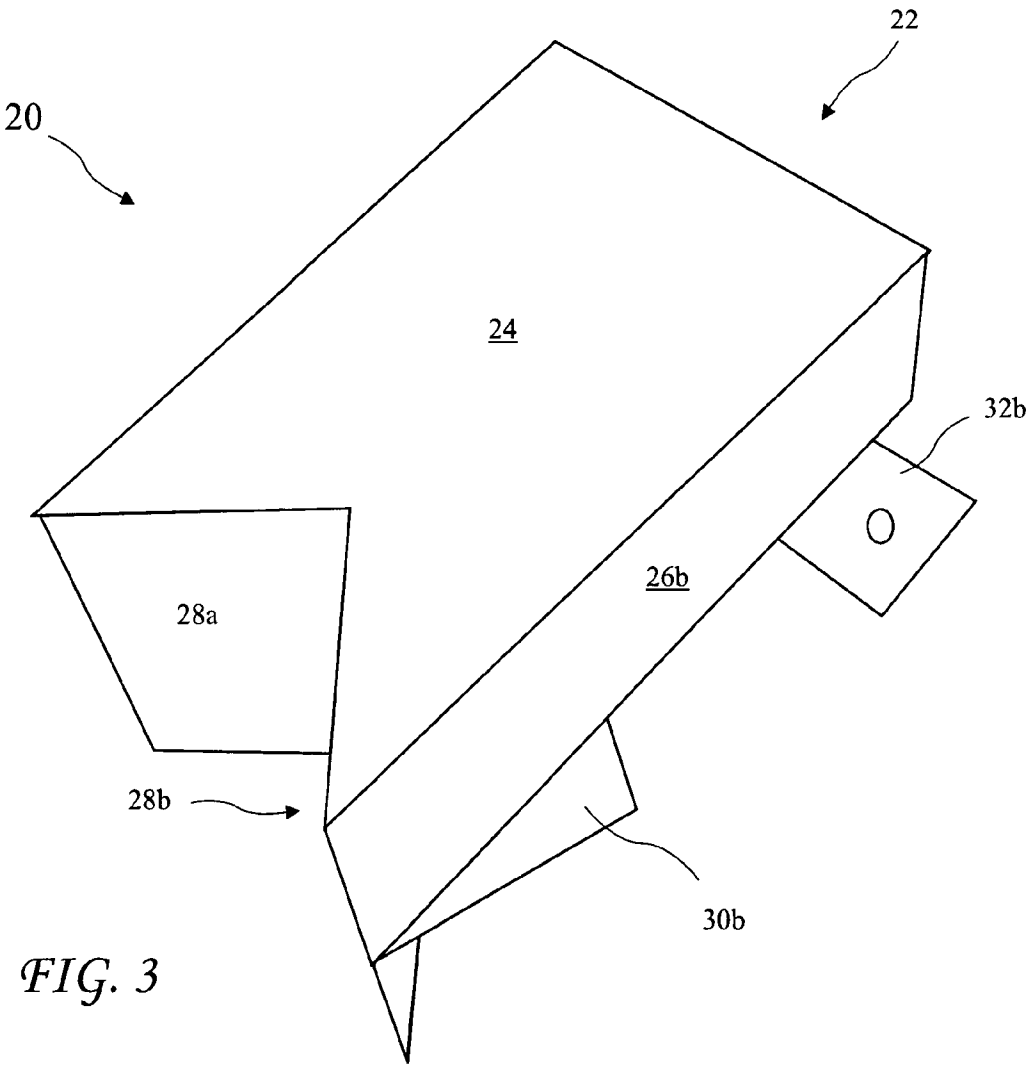
FIG. 3 is a perspective view of the rain gutter diverter according to the present invention.

A perspective view of the rain gutter diverter 20 is shown in FIG. 3. The rain gutter diverter 20 includes a diverter body 20*a* (see FIGS. 5A-5D) and a diverter wall 20*b* (see FIGS. 6A-6D). The diverter body 20*a* has a mount 22 which captures a flow of water running down the valley 17. The flow of water is directed by the diverter body 20*a* toward the diverter wall 20*b*. The diverter wall 20*b* splits the flow of water into a flow into the gutter sections.

Figure 4A:
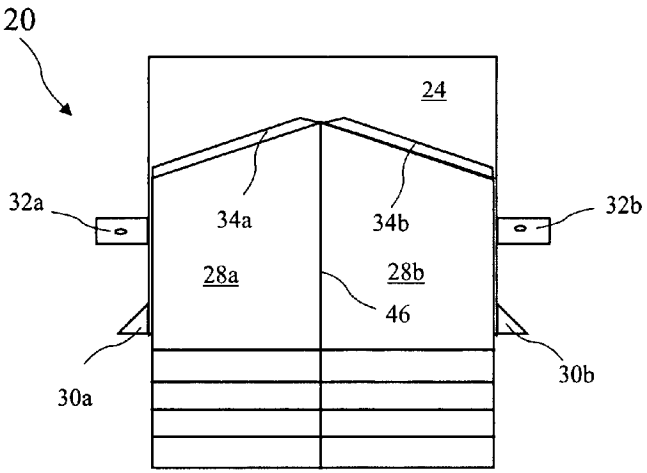
FIG. 4A is a front view of the rain gutter diverter.
Figure 4B:
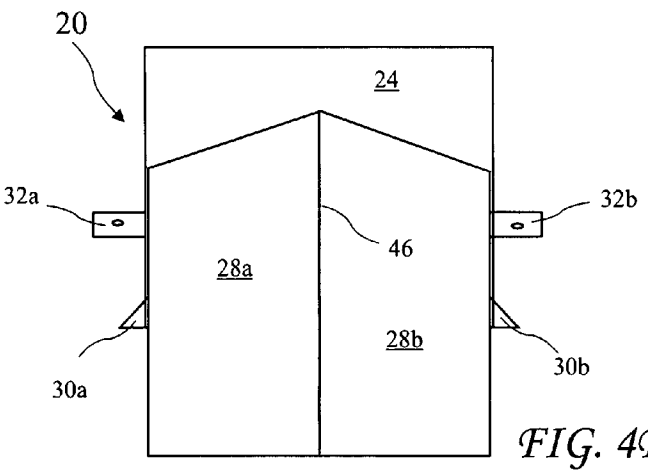
FIG. 4B is a rear view of the rain gutter diverter.
Figure 4D:
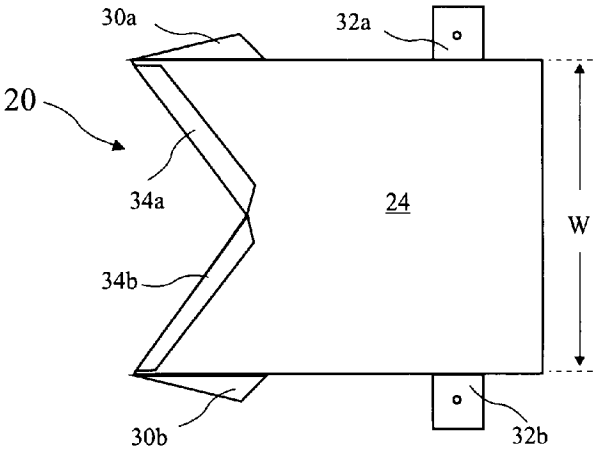
FIG. 4D is a top view of the rain gutter diverter.
Figure 4C:
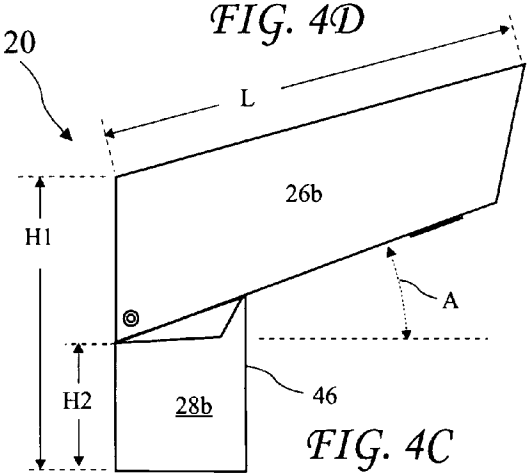
FIG. 4C is a side view of the rain gutter diverter.

A front view of the rain gutter diverter 20 is shown in FIG. 4A, a rear view of the rain gutter diverter 20 is shown in FIG. 4B, a side view of the rain gutter diverter 20 is shown in FIG. 4C, and a top view of the rain gutter diverter 20 is shown in FIG. 4D. The diverter body 20*a* has a body roof 24, a body right side wall 26*a* (not shown) extending downward from a roof right edge, a body left side wall 26*b* extending downward from a roof left edge, and body diverter end 42 and a body mount end 44 opposite the body diverter end 42. A diverter wall 20*b* is attached to the diverter end 42 of the diverter body 20*a* and comprises a right diverter wall 28*a*, a left diverter wall 28*b*, and a vertical splitter 46 separating the right diverter wall 28*a* from the left diverter wall 28*b*.

The vertical splitter 46 forms a "V" pointed toward the mouth end 44 of the diverter body 20*a*. The body roof 24 meets and is substantially sealed to top edges of the right diverter wall 28*a* and the left diverter wall 28*b*, whereby most or all of the water captured by the rain gutter diverter 20 is directed into the gutter sections 16*a* and 16*b*, wherein the escape of a small amount of water from the rain gutter diverter

20 is permissible. The body right side wall 26*a* meets and is substantially sealed to a right edge of the right divert wall 28*a*, and the body left side wall 26*b* meets and is substantially sealed to a left edge of the left diverter wall 28*b*. Such sealing may be accomplished using a common sealant, and is preferably accomplished using a silicone sealant or a plastic roof cement.

The diverter wall 20*b* is an approximately vertical wall, and the divert body 20*a* is attached to the diverter wall to extend upwardly away from the diverter wall 20*b* at between approximately 12 degrees and approximately 25 degrees and is preferably approximately 17 degrees or corresponding to the slope of the valley 17. The rain gutter diverter 20 preferably straddles the valley 17 and resides against the roof sections 14*a* and 14*b* when mounted.

The diverter wall has a full height H1 which is preferably approximately five inches, and a lower portion height H2 which extends below the side walls 26*a* and 26*b* is preferably approximately 2.5 inches. The length L of the roof 24 is preferably approximately 8.5 inches and the width W of the roof 24 is preferably approximately six inches.

Figure 5D:
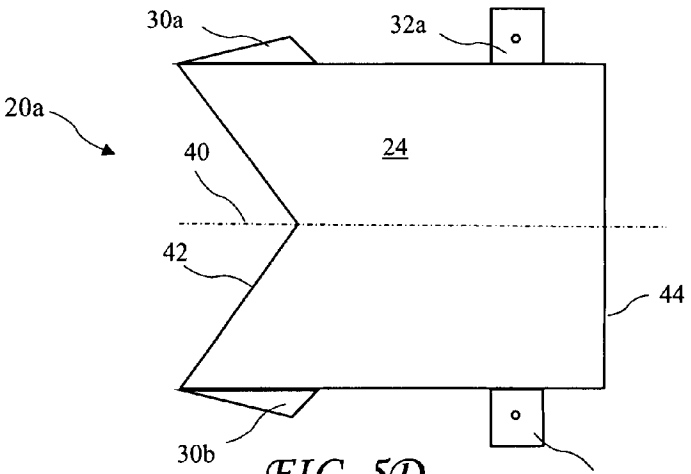
FIG. 5D is a top view of the diverter body.
Figure 5C:
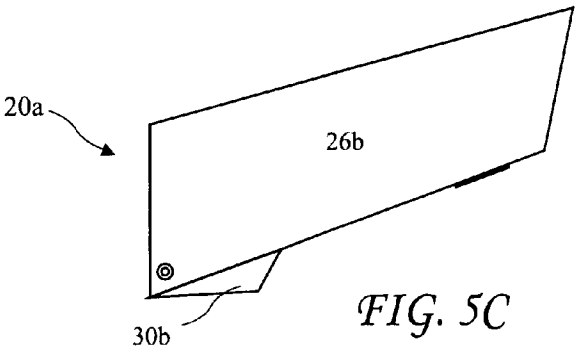
FIG. 5C is a side view of the diverter body.
Figure 5A:
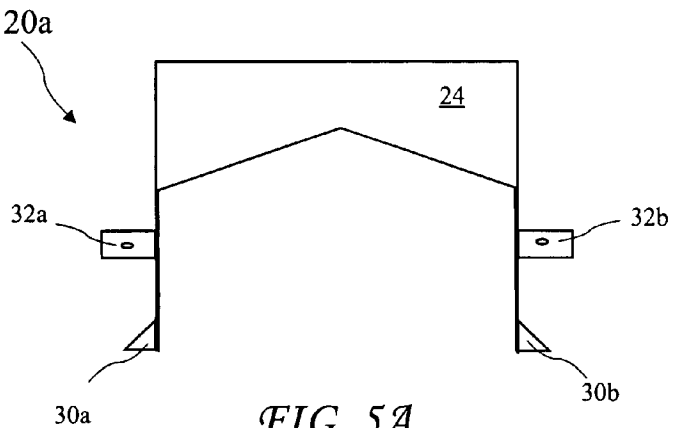
FIG. 5A is a front view of a diverter body according to the present invention of the rain gutter diverter.
Figure 5B:
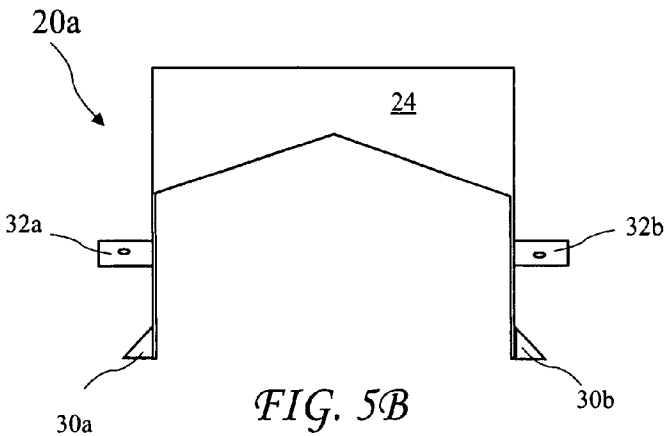
FIG. 5B is a rear view of the diverter body.

A front view of a diverter body 20*a* according to the present invention is shown in FIG. 5A, a rear view of the diverter body 20*a* is shown in FIG. 5B, a side view of the diverter body 20*a* is shown in FIG. 5C, and a top view of the diverter body 20*a* is shown in FIG. 5D. The diverter end 42 of the body roof 24 is shaped to cooperate with the diverter wall 20*b*. The diverter body 20*a* preferably includes guides 30*a* and 30*b* and rear tabs 32*a* and 32*b*, on the right and left sides of the diverter body 20*a* respectively. The guides 30*a* and 30*b* are preferably triangular and help guide water captured by the diverter 20 into the gutters 16*a* and 16*b* (see FIG. 2B) and the rear tabs are preferably square tabs and are used to attach the diverter 20 to the roof 14*a* and 14*b*, preferably using nails, screws, or adhesives.

Figure 6D:
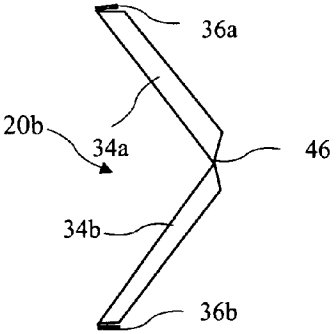
FIG. 6D is a top view of the diverter wall.
Figure 6C:
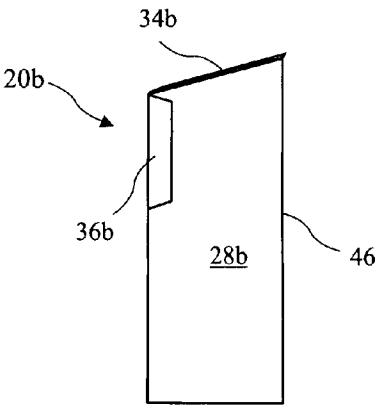
FIG. 6C is a side view of the diverter wall.
Figure 6A:
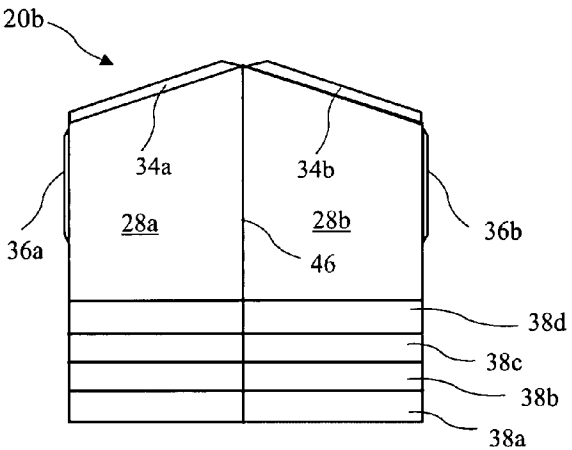
FIG. 6A is a front view of a diverter wall according to the present invention of the rain gutter diverter.
Figure 6B:
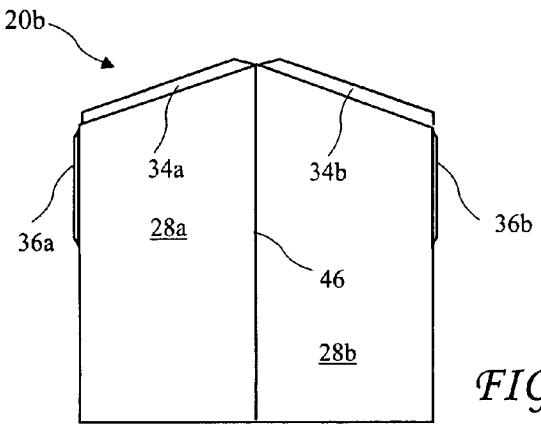
FIG. 6B is a rear view of the rain diverter wall.

A front view of a diverter wall 20*b* according to the present invention of the rain gutter diverter 20 is shown in FIG. 6A, a rear view of the rain diverter wall 20*b* is shown in FIG. 6B, a side view of the diverter wall 20*b* is shown in FIG. 6C, and a top view of the diverter wall 20*b* is shown in FIG, 6D. The diverter wall 20*b* includes breakaway portions 38*a*-38*d* which may individually be broken or cut away from the diverter wall to adjust the rain gutter diverter 20 for different gutter section 16*a* and 16*b* heights with respect to bottom edges of the roof sections 14*a* and 14*b*. The breakaway portions 38*a*-38*d* may be simply marked to allow accurate cutting, or may be etched sufficiently to allow breaking away using, for example, pliers.

The diverter wall 20*b* further includes roof tabs 34*a* and 34*b*, and wall tabs 36*a* and 36*b*. The rain gutter diverter 20 is preferably constructed by attaching the diverter wall 20*b* to the diverter body 20*a* using the tabs 34*a*, 34*b*, 36*a*, and 36*b*. The roof tabs are attached to the roof 24 by, for example, spot welding of or pop riveting, and sealed to the roof 24 by a sealant, preferably silicone or plastic roof cement, and the wall tabs are preferably similarly attached to the walls 26*a* and 26*b*.

The rain gutter diverter 20 is preferably constructed from sheet metal, and more preferably from galvanized sheet metal. However, the rain gutter diverter 20 may also be constructed from any metal or plastic (for example aluminum, galvanized steel, stainless steel, painted or plated steel, copper, brass, or vinyl) and a rain gutter diverter 20 comprising a diverter body and a diverter wall as described herein and made from any material is intended to come within the scope of the present invention.

While the invention herein disclosed has been described by means of specific embodiments and applications thereof, numerous modifications and variations could be made thereto by those skilled in the art without departing from the scope of the invention set forth in the claims.

I claim:

1. A rain gutter diverter comprising:

a diverter body having a body roof, a body right side wall extending downward from a roof right edge, a body left side wall extending downward from a roof left edge, a body centerline, a mouth end, and a diverter end; and a diverter wall attached to the diverter end of the diverter body and comprising a right diverter wall, a left diverter wall and a vertical splitter separating the right diverter wall from the left diverter wall, the vertical splitter pointing toward the mouth end of the diverter body, wherein:

the body roof meets top edges of the right diverter wall and the left diverter wall;

the body right side wall meets a right edge of the right divert wall; and the body left side wall meets a left edge of the left diverter wall.

2. The rain gutter diverter of claim 1, wherein the vertical splitter is aligned with the centerline of the diverter body.

3. The rain gutter diverter of claim 1, wherein the diverter splitter forms a "V" pointed toward the mouth end of the diverter body.

4. The rain gutter diverter of claim 3, wherein the "V" is approximately a 45 degree "V".

5. The rain gutter diverter of claim 1, wherein the diverter wall includes breakaway portions along a bottom edge of the diverter wall whereby the height of the diverter wall may be adjusted.

6. The rain gutter diverter of claim 1, wherein the diverter wall is an approximately vertical wall, and the diverter body is attached to the diverter wall to extend upwardly away from the diverter wall at between approximately 12 degrees and approximately 25 degrees.

7. The rain gutter diverter of claim 1, wherein the diverter body includes mounting tabs extending outward from the lower edges of the body right side wall and the body left side wall.

8. The rain gutter diverter of claim 1, wherein the diverter wall includes roof tabs for attaching the diverter wall to the body roof.

9. The rain gutter diverter of claim 1, wherein the diverter wall includes wall tabs for attaching the diverter wall to the body side walls.

10. The rain gutter diverter of claim 1, wherein the diverter end of the diverter body is substantially sealed on the top and sides by attachment to the diverter wall.

11. A rain gutter diverter comprising:

a diverter body having a body roof, a body right side wall extending downward from a roof right edge, a body left side wall extending downward from a roof left edge, a body centerline, a mouth end, and a diverter end; and a diverter wall attached to the diverter end of the diverter body and comprising a right diverter wall, a left diverter wall and a vertical splitter separating the right diverter wall from the left diverter wall, the vertical splitter forming a "V" pointed towards the mouth end of the diverter body, wherein:

the body roof meets top edges of the right diverter wall and the left diverter wall;

the body right side wall meets a right edge of the right divert wall; and the body left side wall meets a left edge of the left diverter wall.

12. A rain gutter diverter comprising:

a diverter body having a body roof, a body right side wall extending downward from a roof right edge, a body left side wall extending downward from a roof left edge, a body centerline, a mouth end, and a diverter end; and a diverter wall attached to the diverter end of the diverter body and comprising a right diverter wall, a left diverter wall and a vertical splitter separating the right diverter wall from the left diverter wall, the vertical splitter forming a "V" pointed towards the mouth end of the diverter body, wherein:

the body roof meets and is substantially sealed to top edges of the right diverter wall and the left diverter wall;

the body right side wall meets and is substantially sealed to a right edge of the right divert wall; and the body left side wall meets and is substantially sealed to a left edge of the left diverter wall.

* * * * *